US006920713B1

(12) United States Patent
Love

(10) Patent No.: US 6,920,713 B1
(45) Date of Patent: Jul. 26, 2005

(54) GUN SUPPORT FOR HUNTERS

(75) Inventor: Mark E. Love, Huntsville, TN (US)

(73) Assignee: MCL Forest Products, LLC, Huntsville, TN (US)

( * ) Notice: Subject to any disclaimer, the term of this patent is extended or adjusted under 35 U.S.C. 154(b) by 0 days.

(21) Appl. No.: 10/795,596

(22) Filed: Mar. 8, 2004

(51) Int. Cl.[7] ..... F41A 23/52
(52) U.S. Cl. ..... 42/94; 42/90; 89/37.01
(58) Field of Search ..... 42/90, 94; 89/1.7, 89/1.815, 37.01; 124/61, 71, 74.1; 248/125.7, 125.8, 166, 176.1, 643, 674, 351, 122.1, 519; 24/72.1, 170, 3.12, 668

(56) References Cited

U.S. PATENT DOCUMENTS

| | | | | | |
|---|---|---|---|---|---|
| 1,112,732 | A | | 10/1914 | Uhl | |
| 3,225,656 | A | | 12/1965 | Flaherty et al. | 89/37 |
| 3,584,821 | A | * | 6/1971 | Glebe | 248/156 |
| 4,017,997 | A | * | 4/1977 | Peterson et al. | 42/94 |
| 4,333,385 | A | * | 6/1982 | Culver | 89/37.04 |
| 4,345,398 | A | | 8/1982 | Pickett | 42/94 |
| 4,393,614 | A | | 7/1983 | Pickett | 42/94 |
| 4,431,122 | A | * | 2/1984 | Garmong | 224/268 |
| 4,676,021 | A | | 6/1987 | Groba | 42/94 |
| 5,018,294 | A | * | 5/1991 | McGuffee | 42/94 |
| 5,081,782 | A | * | 1/1992 | Wright | 42/94 |
| 5,402,595 | A | | 4/1995 | Tamllos | 42/94 |
| 5,414,949 | A | * | 5/1995 | Peebles | 42/94 |
| 5,491,919 | A | | 2/1996 | Rather et al. | 42/94 |
| 5,524,772 | A | * | 6/1996 | Simmons | 211/4 |
| 5,794,899 | A | | 8/1998 | Tamllos | 248/166 |
| 5,808,227 | A | * | 9/1998 | Amos | 89/36.01 |
| 5,819,463 | A | | 10/1998 | Amos | 42/94 |
| 5,903,995 | A | | 5/1999 | Brubach | 42/94 |
| 5,930,931 | A | | 8/1999 | Watson | 42/94 |
| 5,934,112 | A | * | 8/1999 | Rice et al. | 70/18 |
| 6,086,031 | A | * | 7/2000 | Renfro | 248/218.4 |
| 6,397,507 | B1 | * | 6/2002 | Marshall et al. | 42/72 |
| 6,594,938 | B2 | * | 7/2003 | Horton | 42/127 |
| 6,634,530 | B1 | * | 10/2003 | Black | 224/401 |

* cited by examiner

*Primary Examiner*—Michael J. Carone
*Assistant Examiner*—Daniel Lawson Greene, Jr.
(74) *Attorney, Agent, or Firm*—Luedeka, Neely & Graham PC

(57) ABSTRACT

A gun support for hunters having interchageable features is provided. The gun support includes a support rod having a proximal end and a distal end. A cradle is removably attached to the proximal end of the support rod. The cradle includes a base, a first fork pending from a first side of the base, a second fork pending from a second side of the base, and a retaining device disposed on the first and second fork. A biasing strap is removably attached to the retaining device on at least one of the first fork and second fork. The biasing strap is configured for retaining a gun barrel between the strap and the base of the cradle for steadying the gun of a hunter.

17 Claims, 15 Drawing Sheets

GUN SUPPORT FOR HUNTERS

FIELD

This invention relates to the field of gun rests for firearms. More particularly, this invention relates to a gun rest with interchangeable and reconfigurable features.

BACKGROUND

Hunters and target shooters often have difficulty keeping the barrel of their firearm steady during aiming and shooting. Various factors contribute to that difficulty, including weather, physical infirmities, weakening physical strength and awkward shooting locations.

Besides keeping a steady aim there are other conditions that affect a hunter's success. One factor is that the hunter's prey is typically moving. Another factor is that the hunter needs to maintain a degree of mobility to track targets, and to accommodate targets that approach from unexpected directions. Often the hunter encounters thick brush or tree limbs which block the view of perspective targets. Furthermore, many hunters desire to photograph game and it is difficult to switch between hunting gear and camera equipment Existing devices do not adequately address all of the hunter's needs for mechanical support. What is needed is a device that steadies the hunter's aim under a wide span of environmental conditions, accommodates the hunter's need for mobility, and incorporates features that permit its adaptation to uses beyond just supporting a firearm while aiming and shooting.

SUMMARY

With regard to the above, in one of its embodiments the invention provides a support rod having a proximal end and a distal end and a cradle, removably attached to the proximal end of the support rod. The cradle incorporates a base, a first fork pending from a first side of the base, a second fork pending from a second side of the base, and a retaining device disposed on the first and second fork. A biasing strap is removably attached to the retaining device on at least one of the first fork and second fork, wherein the biasing strap is configured for retaining a gun barrel between the strap and the base of the cradle.

Certain embodiments incorporate a support rod having a proximal end and a distal end and a cradle, removably attached to the proximal end of the support rod. The cradle has a base and a first fork pending from a first side of the base and a second fork pending from a second side of the base and the base is attached to the proximal end of the support rod. The first fork and the second fork form a generally urceolate profile, and a removable biasing strap attaches to the first fork and the second fork of the cradle at a narrow point in the urceolate profile.

In an alternate embodiment a support rod having a proximal end and a distal end is provided. Also provided is a single cradle having a base and a first fork pending from a first side of the base and a second fork pending from a second side of the base. There is a removable biasing strap connecting the first fork and second fork, wherein the biasing strap is configured for retaining a gun barrel between the strap and the base of the cradle. Finally, a swivel assembly connects the proximal end of the support rod to the base of the cradle.

According to another embodiment, a support rod having a proximal end and a distal end has a lance attached to the distal end of the support rod and a cradle is attached to the proximal end of the support rod. The cradle has a base and a first fork pending from a first side of the base and a second fork pending from a second side of the base and a support base is attached to the support rod near its distal end where, when the support base is in its deployed position, a lance extends beyond the bottom of the support base.

One advantage of the invention is its ease of use and adaptability to a variety of gun types and sizes. Incorporation of means to support the gun without unduly restraining its movement about a field of aim is also a beneficial aspect of the invention. Other advantages of various embodiments include enhanced portability and minimal setup time. Also, as will be seen in the detailed description of various embodiments, provisions for alternate types of support bases are incorporated to meet the diverse needs of hunters. Finally, embodiments are provided that incorporate interchangeable accessories, thereby enhancing the versatility and utility of the invention for hunters.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
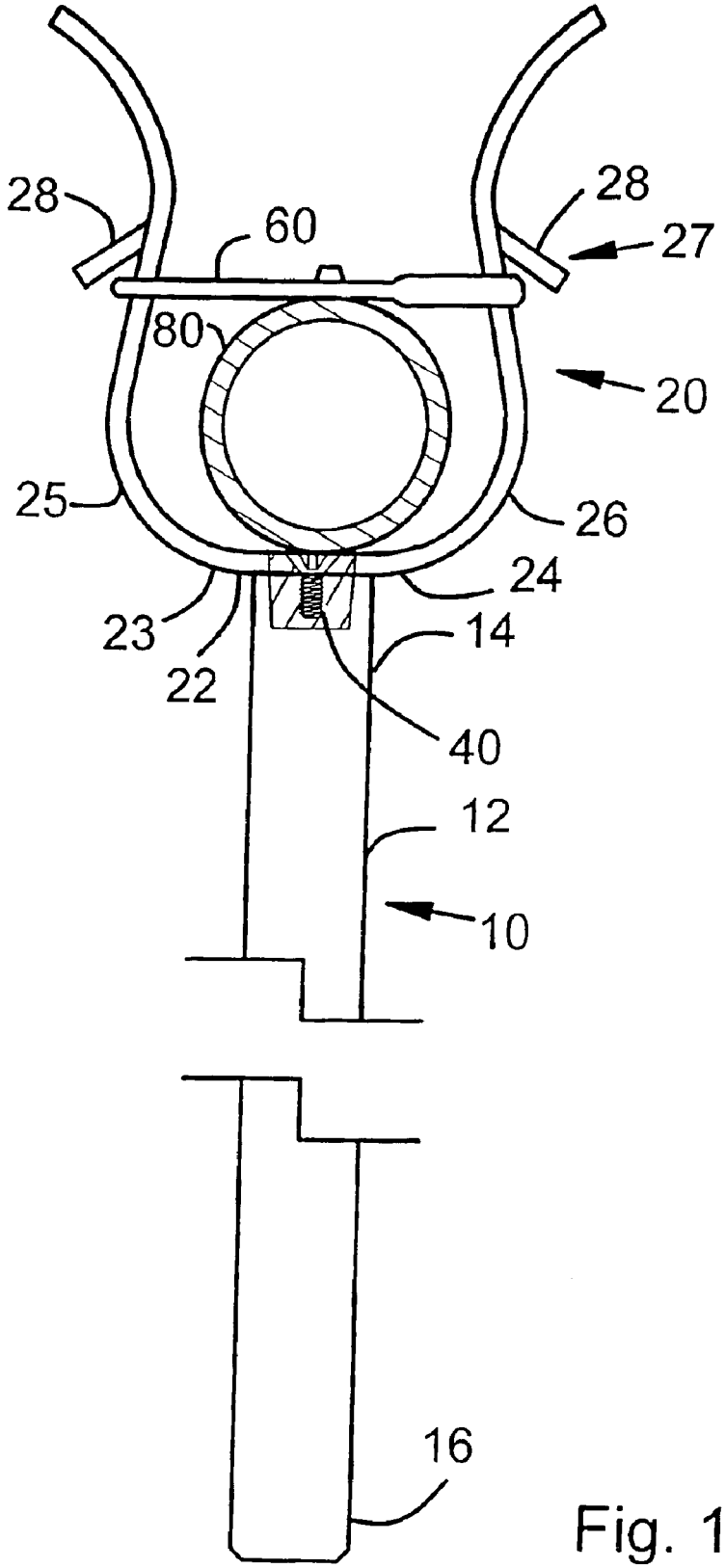
FIG. 1 is an elevational view of a gun support for -hunters according to the invention.

With reference now to FIG. 1, a gun support for hunters, comprising pole gun support 10, is illustrated. The pole gun support 10 includes a support rod, such as support rod 12 shown here. The support rod 12 has a proximal end 14 and a distal end 16. In one alternate embodiment as described further hereinbelow, the support rod comprises a telescoping support rod. In some embodiments the support rod may incorporate a camouflage pattern to help conceal the gun support from detection by prey.

A cradle, such as cradle device 20 is attachable by means described herein later to the proximal end 14 of the support rod 12. The cradle device 20 comprises a base 22 with a first side 23 of base 22 and a second side 24 of base 22. A first fork 25 pends from the first side 23 of base 22, and a second fork 26 pends from the second side 24 of base 22. In this embodiment, the cradle device 20 employs a retaining device 27. In this embodiment the retaining device 27 comprises pawls 28 pending from each of the first fork 25 and the second fork 26.

Figure 2:
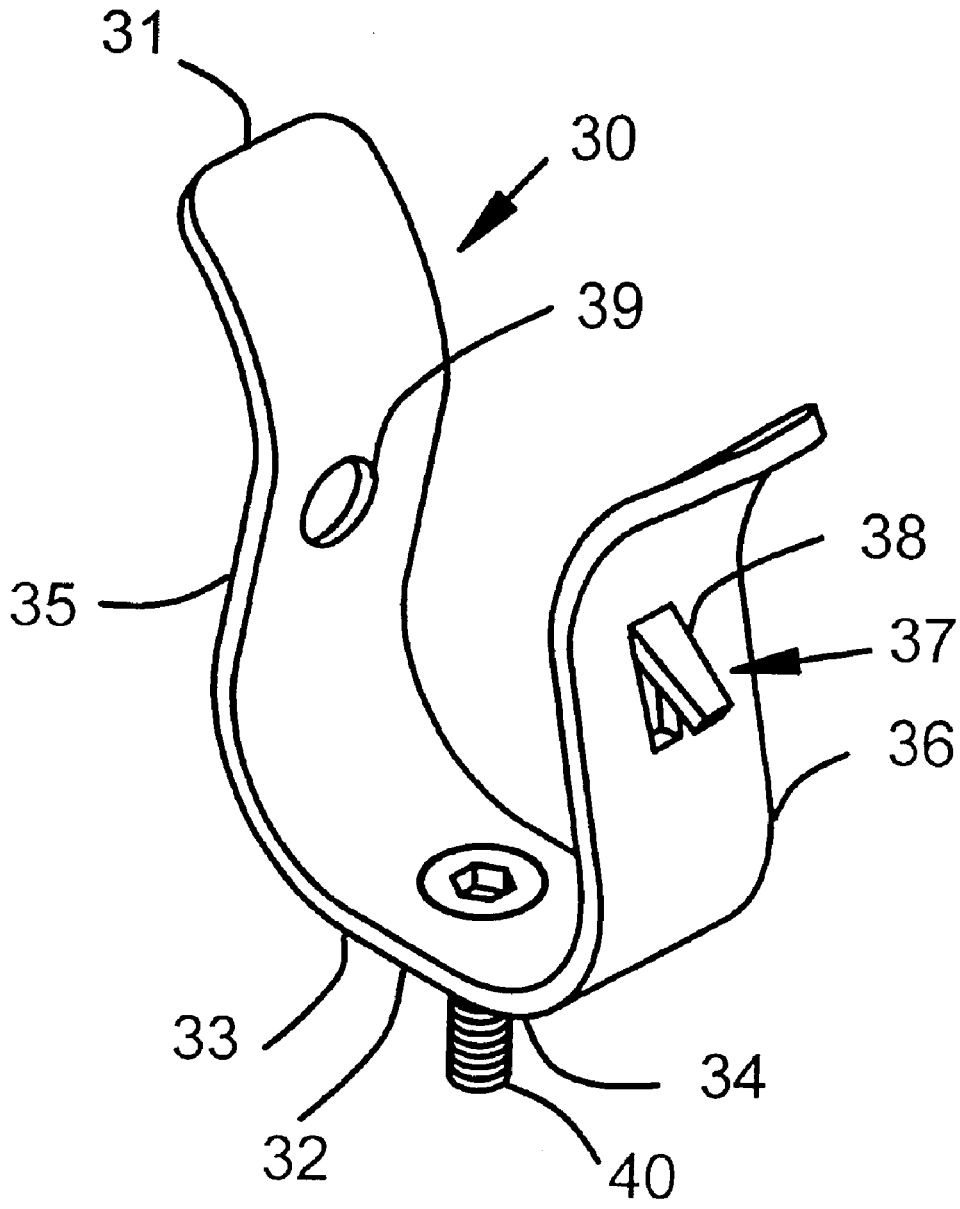
FIG. 2 is a perspective view of a cradle for a gun support according to the invention.

FIG. 2 depicts an alternate embodiment of a cradle 30 according to the invention. The cradle 30 is an asymmetric cradle having a base 32 with a first side 33 of base 32 and a second side 34 of base 32. A first fork 35 pends from the first side 33 of base 32, and a second fork 36 pends from the second side 34 of base 32. This embodiment employs an alternate retaining device, a heterotypic retaining device including a pawl 38 on second fork 36 and an opening 39 on first fork 35 of asymmetric cradle 30. As illustrated in FIG. 2, if a fork (such as second fork 36) is constructed from thin material, such as sheet metal, a pawl (such as pawl 38 shown here) may be fabricated by partially punching a notch in the fork 36 and bending the notch outward to form the pawl 36. The asymmetric cradle 30 is specifically designed to be used with a preferred biasing strap described in more detail below.

Figure 3:
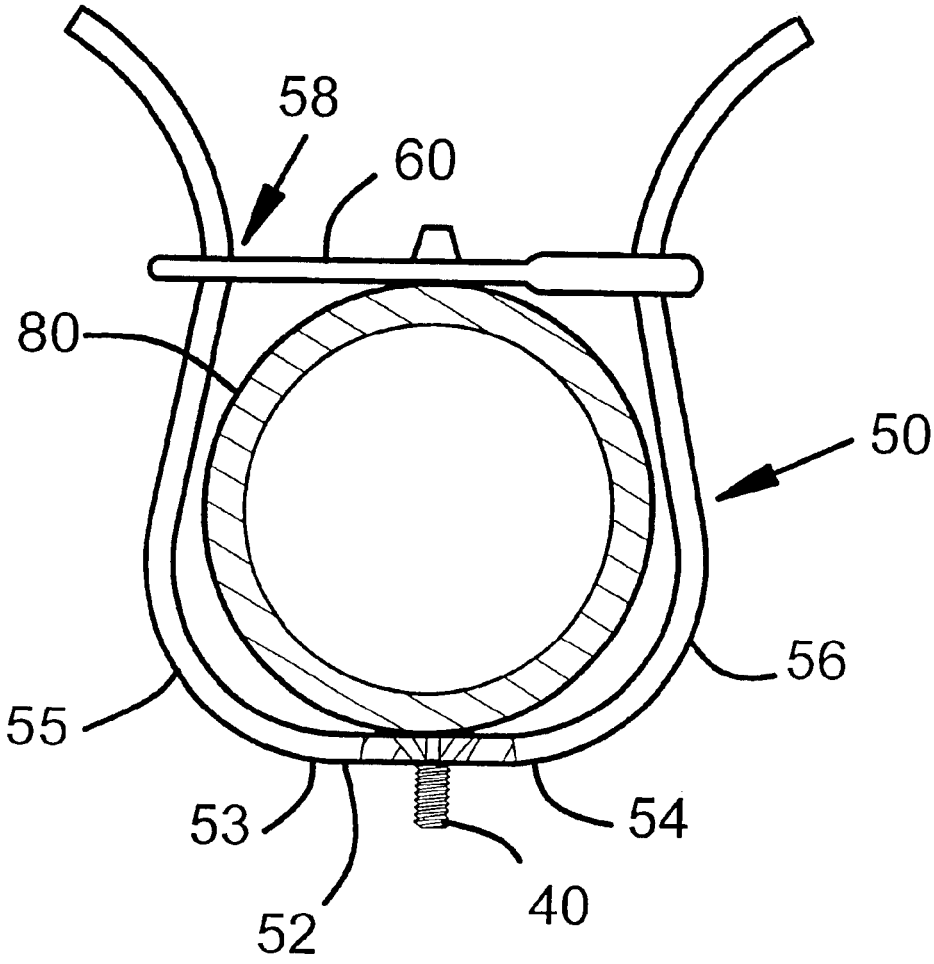
FIG. 3 is an elevational view of a cradle incorporating forks with an urceolate profile for a gun support according to the invention.

FIG. 3 illustrates an alternate embodiment of a cradle 50 that is urceolate (urn-shaped) in profile. The urceolate cradle 50 comprises a base 52 having a first side 53 and a second side 54. A first fork 55 pends from the first side 53 and a second fork 56 pends from the second side 54 of the base 52 of urceolate cradle 50. Each fork has a generally urceolate profile. There is a narrow point 58 between the first fork 55 and the second fork 56. A biasing strap 60 is shown connecting the first fork 55 and the second fork 56 at the narrow point 58. In this embodiment a biasing device, biasing strap 60, is cooperatively engaged with the narrow point 80, such that when the biasing strap 60 is connected between the first fork 55 and second fork 56 it retains a gun barrel, in this case shotgun barrel 80 between the biasing strap 60 and the base 52 of the urceolate cradle 50.

In various alternate embodiments, the cradle may be coated with polymeric compound coating on its surface, typically having a durometer ranging from about 40 to about 60. In other alternate embodiments the cradle may be a single-piece molded plastic part Coated cradles and plastic cradles are referred to as soft cradles. A soft cradle helps prevent scratching of the gun barrel, and reduces equipment contact noise in the field. In some embodiments some surfaces of the cradle are covered with a camouflage pattern.

In the embodiments depicted in FIGS. 1, 2, and 3, the method of attaching the cradle to the support rod is a threaded fastener 40. When a threaded fastener is used, it is preferred to use ¼–20 threads, since that is standard threading for camera mounts and other accessory devices which can be used with a support rod. However, in embodiments where easy removal of the cradle is not required, a rivet, a weld, a braze, or similar mechanism may be used, for example, to fixedly attach cradle device 20 to support rod 12 in FIG. 1. In other alternate embodiments, to be described in greater detail hereinbelow, a swivel assembly may be used to connect the cradle to the support rod 12.

In the embodiment of FIG. 1, a biasing device, in this case biasing strap 60, is cooperatively engaged with the retaining devices 27 and 28, such that when the biasing strap 60 is connected between the first fork 25 and second fork 26 it retains a gun barrel, in this case shotgun barrel 80, between the strap 60 and the base 22 of the cradle device 20.

Figure 4:
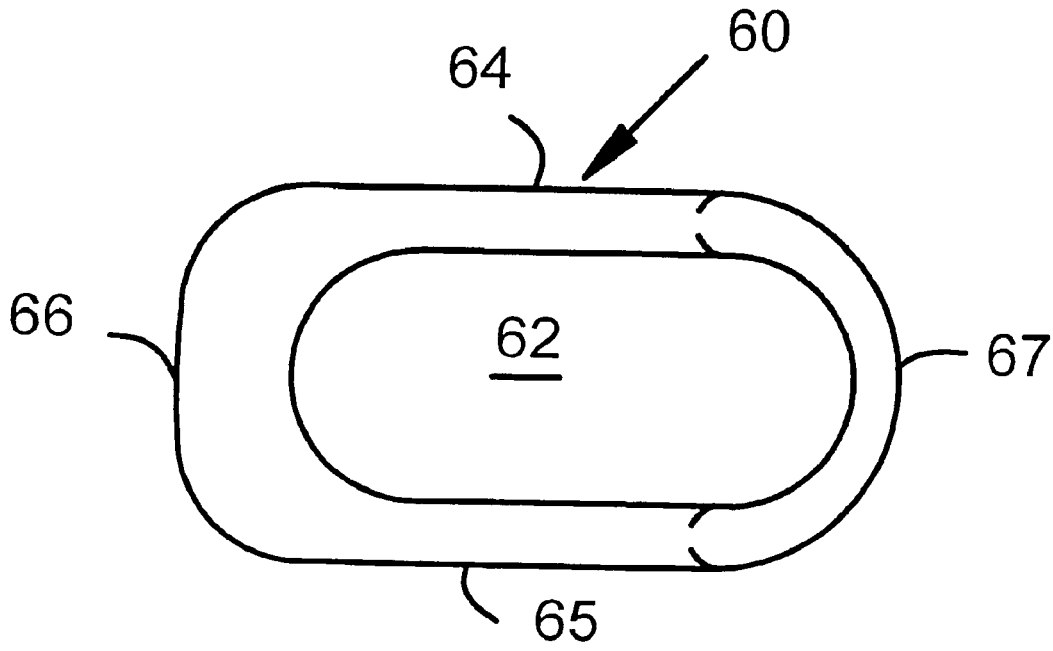
FIG. 4 is a plan view of a biasing device for use in a gun support according to the invention.
Figure 5:
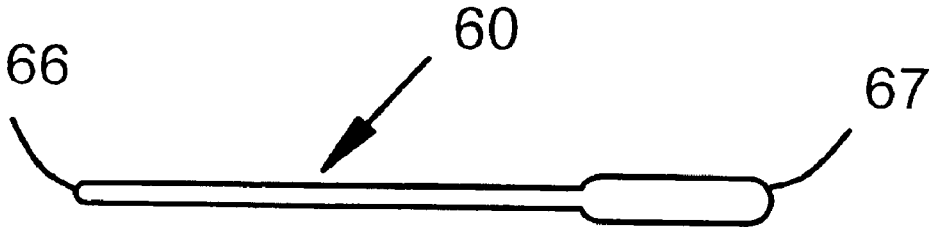
FIG. 5 is a side view of the biasing device depicted in FIG. 4.

In some biasing device embodiments, as depicted in FIG. 4, the biasing strap 60 comprises an elongate strap having a substantially oblong opening 62 between opposite sides 64 and 65 and opposing ends 66 and 67. As depicted in the edge view of biasing strap 60 that is presented in FIG. 5, material thickness variations between opposing ends 66 and 67 may be employed in order to enhance its strength and to facilitate the removal and replacement of the elongate strap 60 on the cradle device 20.

In one embodiment, biasing strap 60 may be retained on the first fork 35 of asymmetric cradle 40 (FIG. 2), by semi-permanently attaching the biasing strap 60 to the opening 39 on first fork 35. For example, if an elongate strap is employed, such as the biasing strap 60 depicted in FIG. 4, it may be semi-permanently retained on the first fork 35 of asymmetric cradle 40 by pushing end 66 of biasing strap 60, for example, through the opening 39 on the first fork 35 of asymmetric cradle 30, and then looping end 66 back over edge 31 of first fork 35. When the gun support containing cradle 30 is deployed in the field, the gun barrel is placed in the asymmetric cradle device 30 and the opposing end 67 of the biasing strap 60 is looped over the gun barrel 80 onto second fork 36 of asymmetric cradle 30 and secured by the pawl 38 on the second fork 36. It will be recognized that end 67 of the biasing strap, instead of end 66, may be threaded through opening 39 and then looped over edge 31 of the first fork 35.

Some alternate embodiments of a biasing strap employ additional features. For example, in a preferred embodiment according to FIG. 6, a top view of a barbed biasing strap 70 shows an oblong opening 72 between opposite sides 74 and 75 and a first end 76 and a second end 77. In this embodiment of a biasing strap, a compressible barb 78 is affixed to the second end 77. The major diameter of the compressible barb 78 is sized to be slightly larger than the opening 39 in the first fork 35 of asymmetric cradle 30 depicted in FIG. 2, so that the compressible barb 78 may be pushed into the opening 39 on first fork 35 and thereby be semi-permanently retained on the first fork 35. In some embodiments of a biasing device (shown as barbed biasing strap 70 in FIG. 6), a tab 79 is attached to the first end 76 to facilitate the removal and replacement of the barbed biasing strap 70 from and onto the second fork 36 of the asymmetric cradle 30 depicted in FIG. 2.

Figure 6:
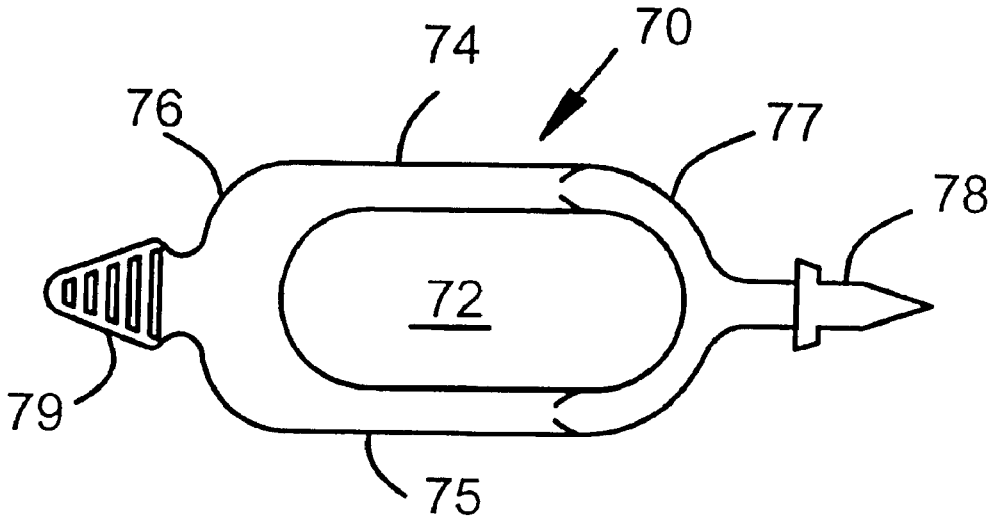
FIG. 6 is a plan view of an alternate biasing device for a gun support according to the invention.
Figure 7:
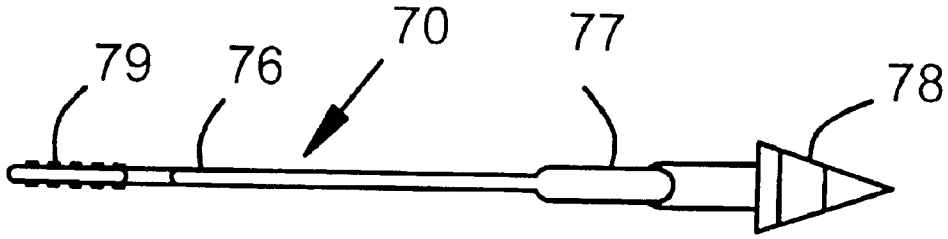
FIG. 7 is a side view of the biasing device depicted in FIG. 6.

FIG. 7 illustrates the edge view of the barbed biasing strap 70 depicted in FIG. 6. Variations in material thickness between opposing ends 76 and 77 are depicted which strengthen the barbed biasing strap 70 at points of mechanical wear and stress.

In a preferred embodiment the elasticity of the biasing strap 60 and barbed biasing strap 70 is sufficient to permit the strap to be removed and replaced across the forks of a cradle. This is accomplished by forming the biasing strap 60 and barbed biasing strap 70 from molded natural or synthetic rubber. In some embodiments a degree of springiness is designed into the first fork 25, 35 or 55 and the second fork 26, 36, or 56 to further facilitate removal/replacement of the biasing device. This can be accomplished by fabricating the cradle device 20, asymmetric cradle device 30, or urceolate cradle 50 from sheet metal of approximately 11 gauge or thinner.

Figure 8:
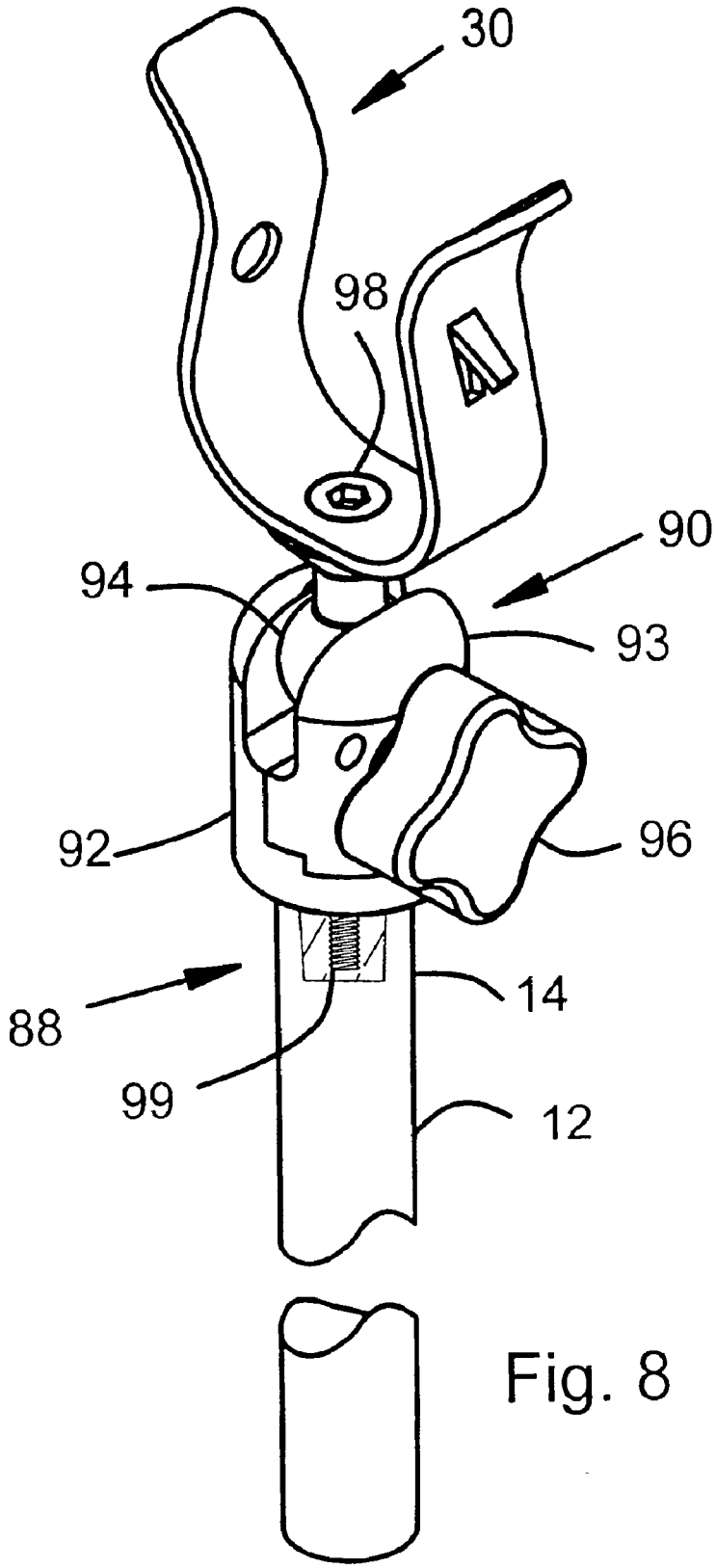
FIG. 8 is a perspective view of a gun support with a swivel assembly according to the invention.

As previously noted, in some embodiments the cradle is attached to the support rod with a threaded fastener. See for example threaded fastener 40 in FIGS. 1, 2 and 3. However, in a most preferred embodiment, a swivel assembly is used to connect the cradle and the support rod. FIG. 8 depicts a preferred swivel gun support 88 comprising a support rod 12 and asymmetric cradle 30 joined together with a ball joint swivel 90. The ball joint swivel 90 comprises a base socket 92 and a clamp socket 93. A ball mount 94 is positioned between the base socket 92 and the clamp socket 93, and the base socket 92 and clamp socket 93 are joined by a threaded fastener (hidden) attached to a swivel lock knob 96. When the swivel lock knob 96 is rotated it turns the threaded fastener to tighten or loosen the ball mount 94. A ball mount fastener 98 attaches the asymmetrical cradle 30 to the ball mount. A post fastener 99 attaches the ball joint swivel 90 to the proximal end 14 of support rod 12.

When the gun barrel is retained in the gun support the swivel lock knob 96 of ball joint swivel 90 is generally tightened before the gun support is placed in use for aiming and firing. When the hunter desires to change hunting locations, the swivel lock knob 96 of ball joint swivel 90 can be loosened and then the support rod (e.g., support rod 12) can be swung adjacent the gun barrel or stock for easy transportation. Various types of swivel assemblies may be used such as swivels that operate on a single plane and employ a wing nut for tightening. However, a ball joint swivel 90 is preferred because it better compensates for some misalignment with, and potential interference between, the support rod and parts of the gun when the support rod is swung adjacent the gun barrel or stock.

Figure 9:
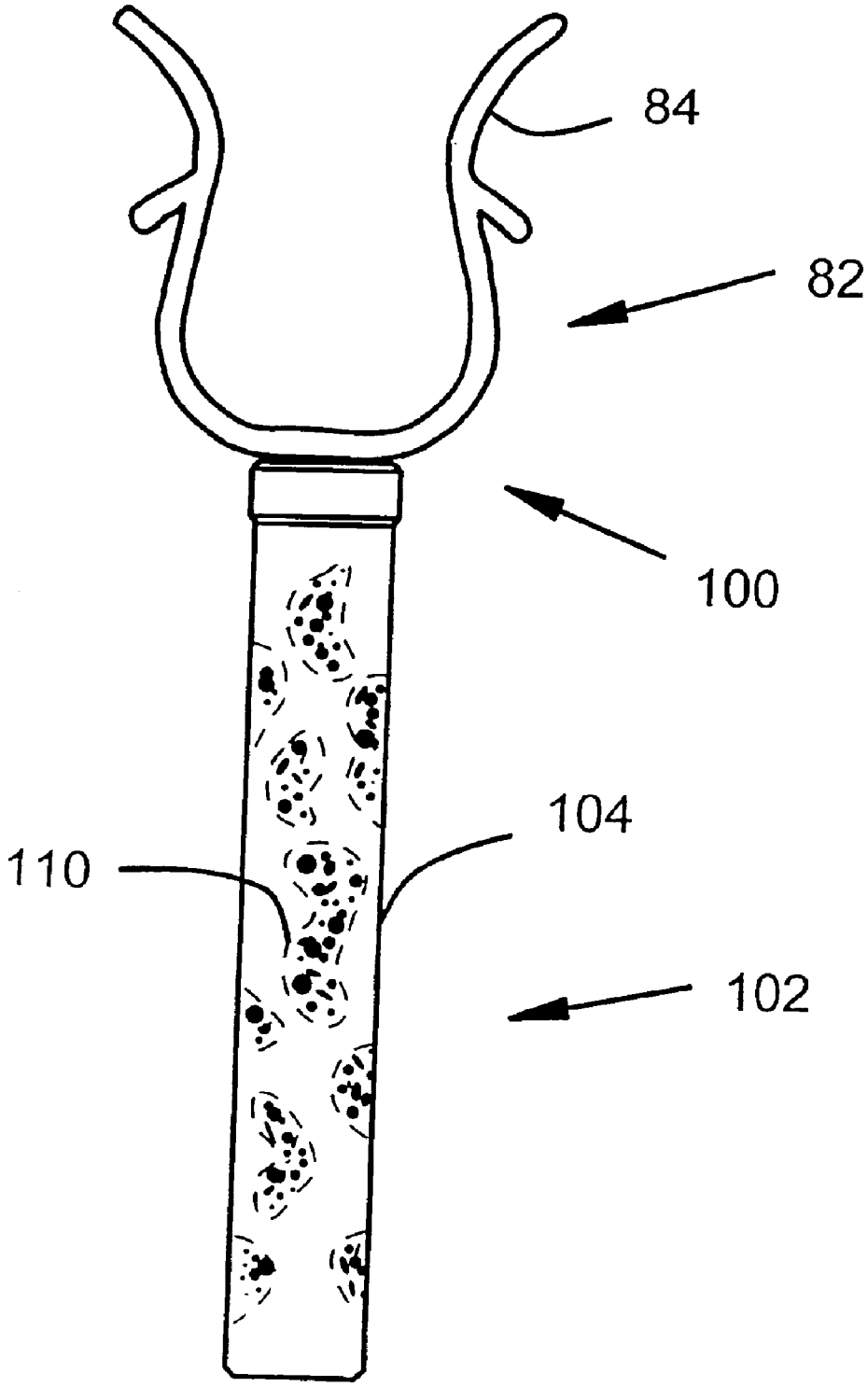
FIG. 9 is an elevational view of a telescoping gun support, incorporating an elastomeric coated cradle according to the invention.

Various alternate embodiments employ additional features. For example FIG. 9 illustrates a telescoping gun support 100 where, as a preferred embodiment, the support rod comprises a telescoping support rod 102. In this illustration, only the telescoping support rod first section 104 is visible; additional sections are nested inside the first section 104. It is desirable to have the telescoping support rod 102 be extendible from about nine inches to about six feet. This can be accomplished by nesting up to about twelve separate sections in the support rod 102. FIG. 9 also illustrates a coated cradle 82 that is formed from metal and has a polymeric compound coating 84 on its exposed surfaces.

Figure 10:
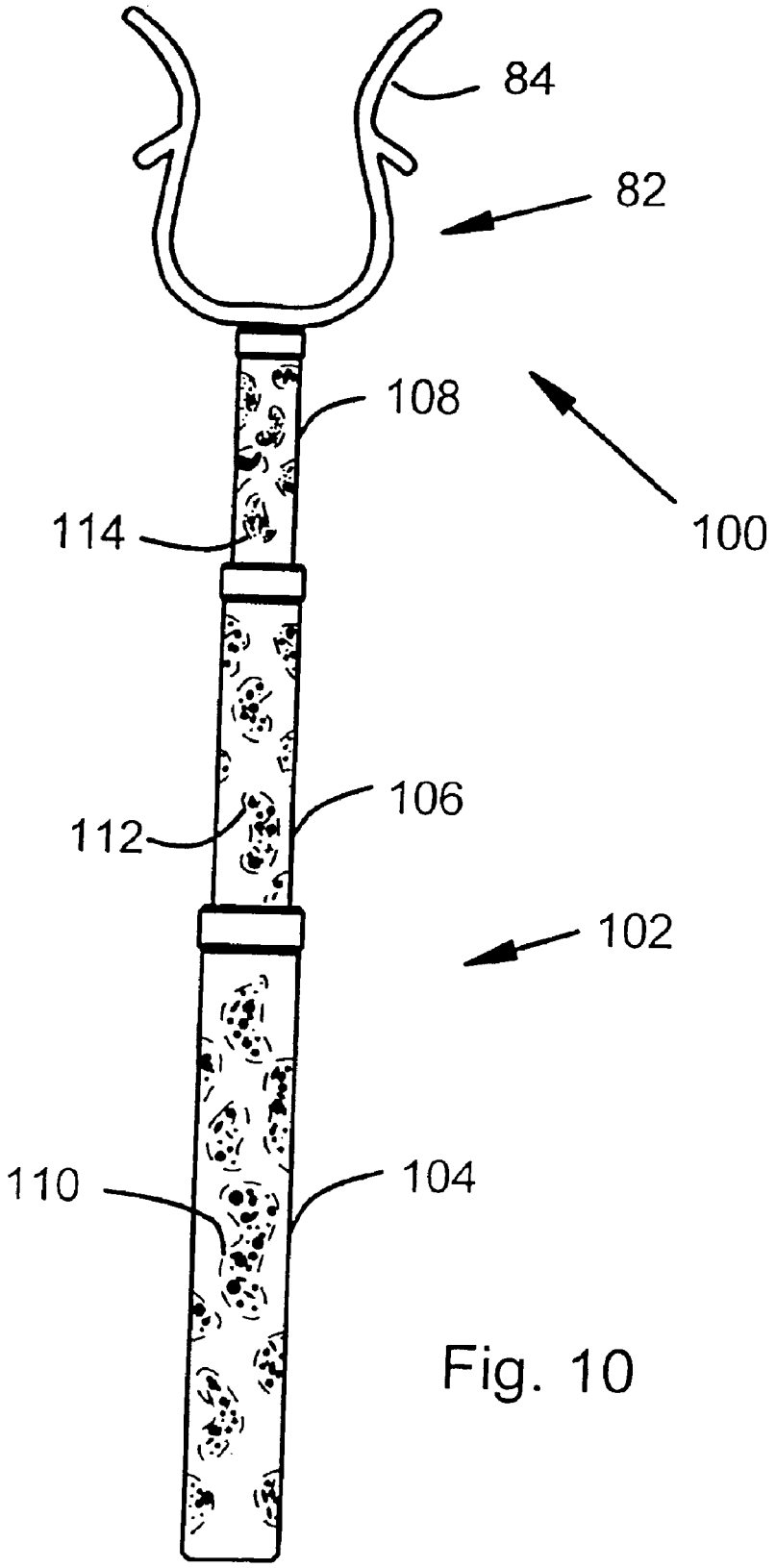
FIG. 10 is an elevational view of a telescoping gun support, showing sections extended and camouflage patterns according to the invention.

FIG. 10 illustrates a view of telescoping gun support 100 with telescoping support rod 102 where the first section 104, a second section 106, and a third section 108 of the telescoping support rod 102 are partially extended. In this illustration camouflage patterns 110, 112 and 114 are also applied to the telescoping support rod 102. In other embodiments the camouflage patterns 110, 112, and 114 may be applied to support rod 10 and/or the cradle device 20, asymmetrical cradle 30, or urceolate cradle 50. The camouflage patterns may be applied to the telescoping support rod 102 and/or cradle 82 by applying the patterns using paint, decals or other surface treatment containing the appropriate colors and arrangement of colors.

Figure 11:
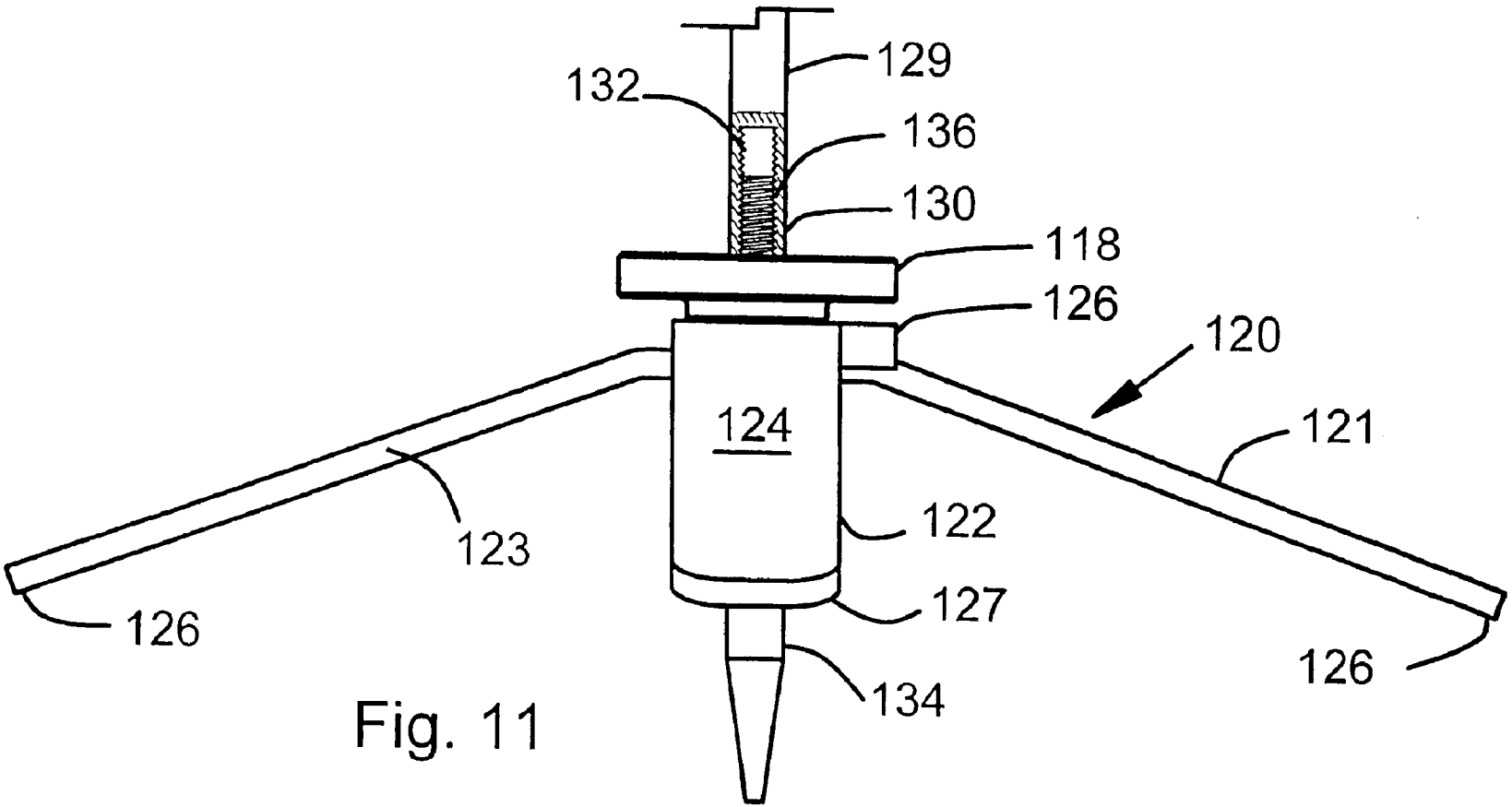
FIG. 11 is an elevational view of a quadrapod stand for a gun support according to the invention.

According to another embodiment, a support base is removably attached to the support rod 12 or 102. One example of a support base is the quadrapod stand 120 depicted in FIG. 11. The quadrapod stand 120 comprises first elongate member 121 and second elongate member 122 that are attached to the distal end of a support rod such as distal end 130 of support rod 129. In this embodiment the first elongate member 121 is shaped to provide a rigid bilateral member 123 formed to create a deployed feet 126 at each end of bilateral member 123, and second elongate member 122 is shaped to provide a rigid bilateral member 124 formed to create feet 127 at each end of the bilateral member 124. FIG. 11 also illustrates an optional alignment lug 126 attached to the first or second elongate member 121 or 122 to maintain their orthogonality with respect to each other when members 121 and 122 are rotated into a support position shown in FIG. 12. During transport, elongate members 121 and 122 may be rotated to an overlapping orientation.

In one embodiment as illustrated in FIG. 11, a lance 134 is mounted at the distal end 130 of the support rod 129. Support rod 129 has female threads 132 cut into the distal end 130. Lance 134 has a male threaded upper portion 136 that screws into the female threads 132. As further described below, an optional threaded locking wheel 118 may be used to tighten the first elongate member 121 and second elongate member 122 onto the lance 134 to prevent rotation of the elongate members 121 and 122 when the feet 126 and 127 are deployed or when the members 121 and 122 are overlapped for transporting the gun support 10. The lance 134 is designed to be inserted into an object, such as a log or the ground, in order to help stabilize the gun support. Note that in the embodiment of FIG. 11 the lance 134 extends below the bottom of the support base (quadrapod stand 120 in this embodiment).

Figure 12:
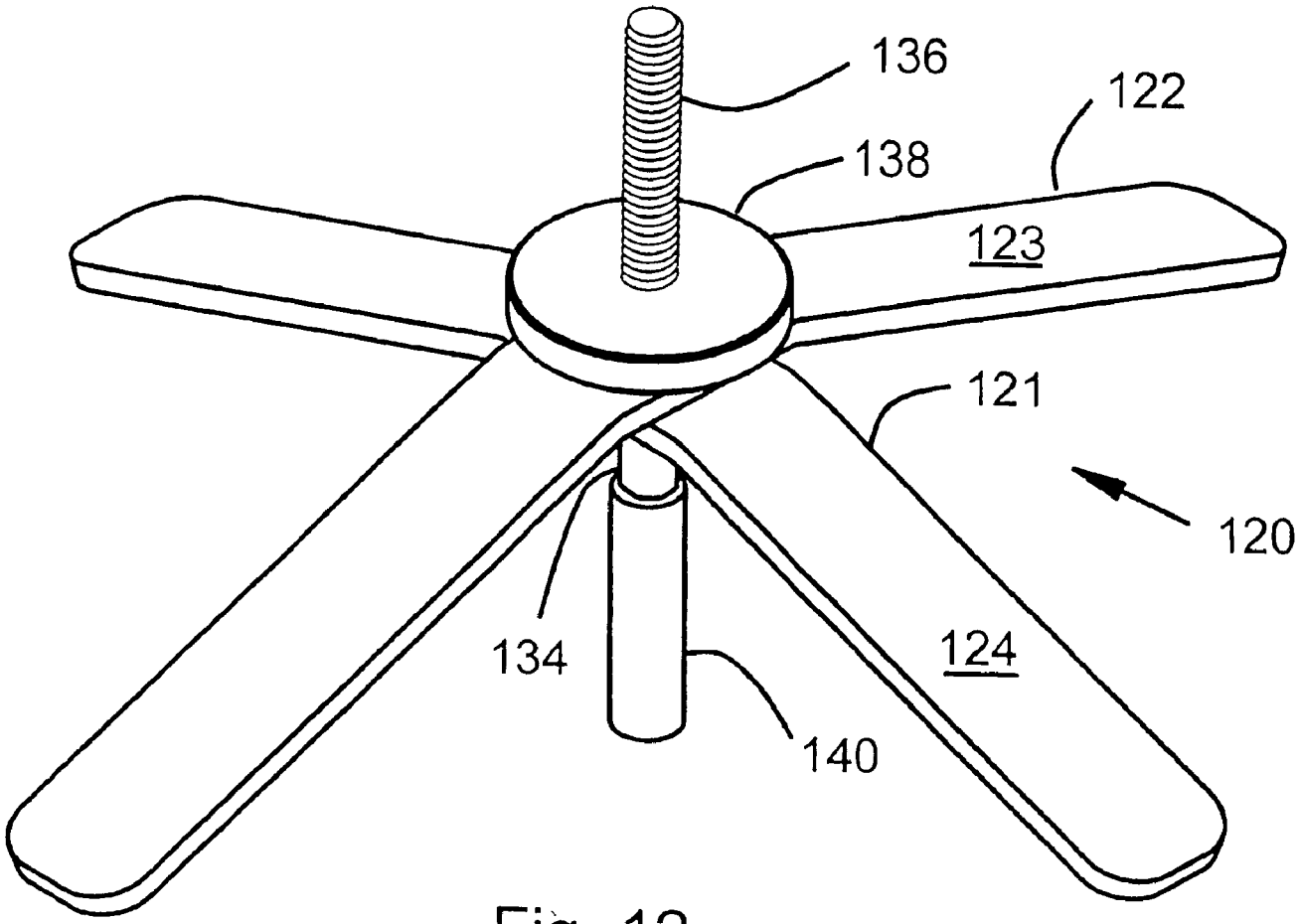
FIG. 12 is a perspective view of a quadrapod stand for a gun support according to the invention.

FIG. 12 further illustrates an alternate embodiment of a support base. Here, lance 134 is shown to have a threaded upper portion 136. Optional threaded locking wheel 138 is shown tightened against the first and second elongate members 121 and 122 to secure the members to the lance 134 and to prevent rotation of the members as described above. FIG. 12 also illustrates an optional protective cover 140 that may be used to cover the lance 134 during transportation. The optional alignment lug 126 of FIG. 11 is not depicted in FIG. 12.

Figure 13:
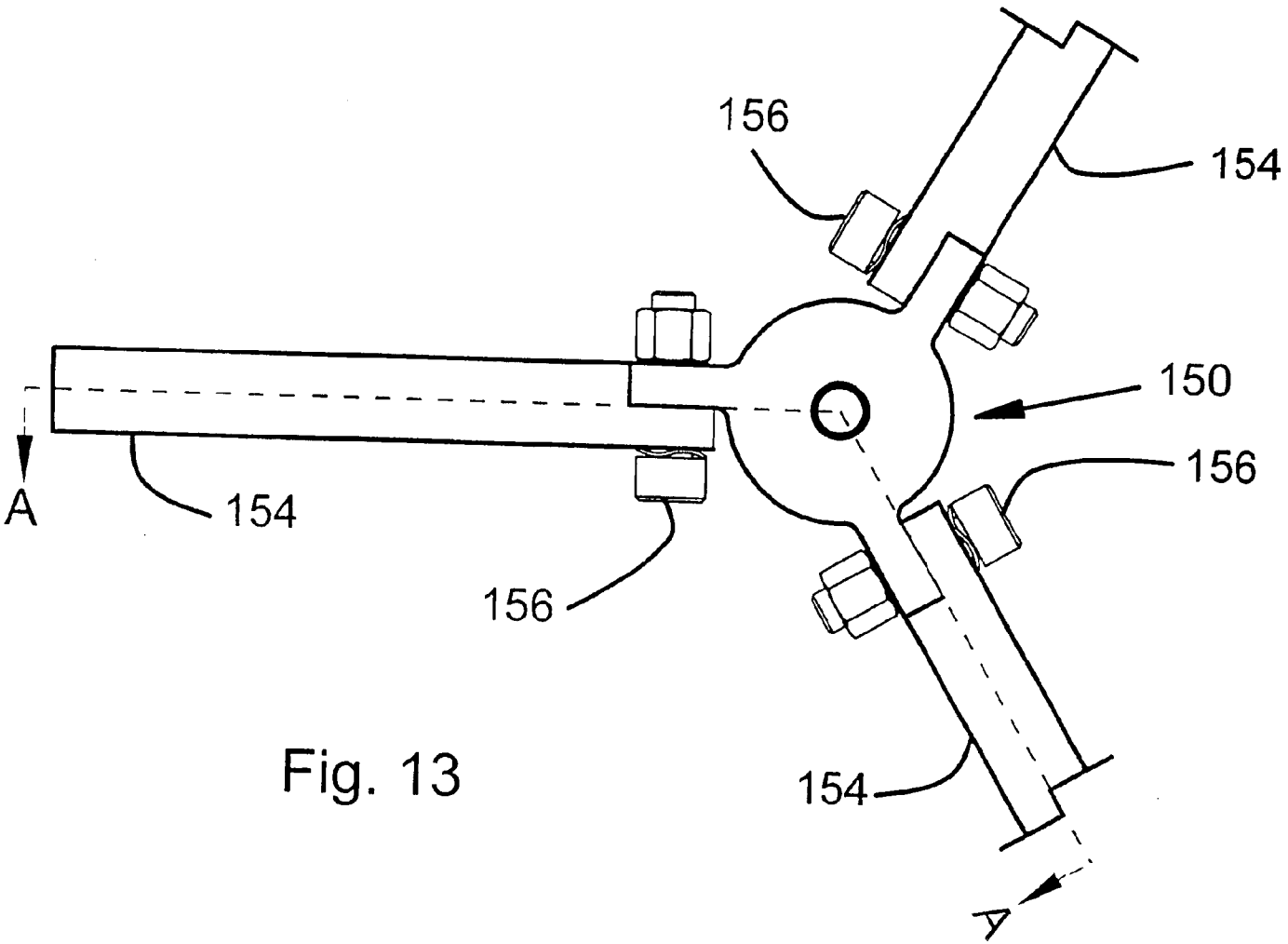
FIG. 13 is a top plan view of a support base having an array of foldable legs according to the invention.

In another embodiment of a support base, as depicted in FIG. 13, a support base comprising a foldable tripod stand 150 is illustrated. Foldable legs 154 are attached to a center support 152 by leg fasteners 156. The leg fasteners 156 comprise a standard bolt, nut and lock washer assembly or may include a wing nut for faster folding and set up. An array of three foldable legs 154 is illustrated in this example, but an array of as few as two foldable legs 154 (forming a bipod) or more than three foldable legs may also be used. The foldable legs 154 are shown in their deployed position.

Figure 14:
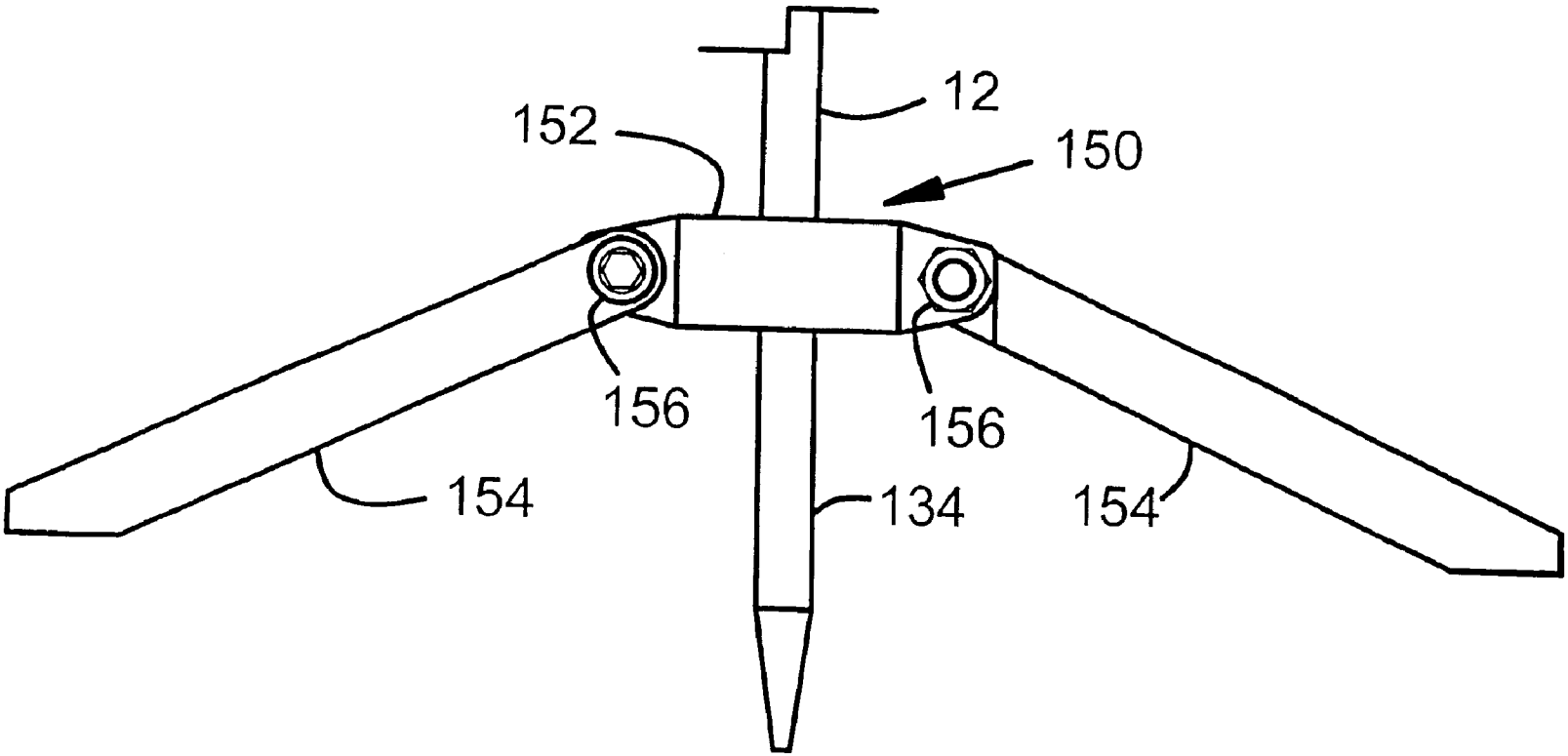
FIG. 14 is an elevational view of a support base having an array of foldable legs, showing the legs in their deployed position, according to the invention.

FIG. 14 shows an elevation view of foldable stand 150, taken through section A—A of FIG. 13. This view depicts a configuration where the lance 134 extends beyond the support base (foldable stand 150 in this embodiment) when the support base is in its deployed position.

Figure 15:
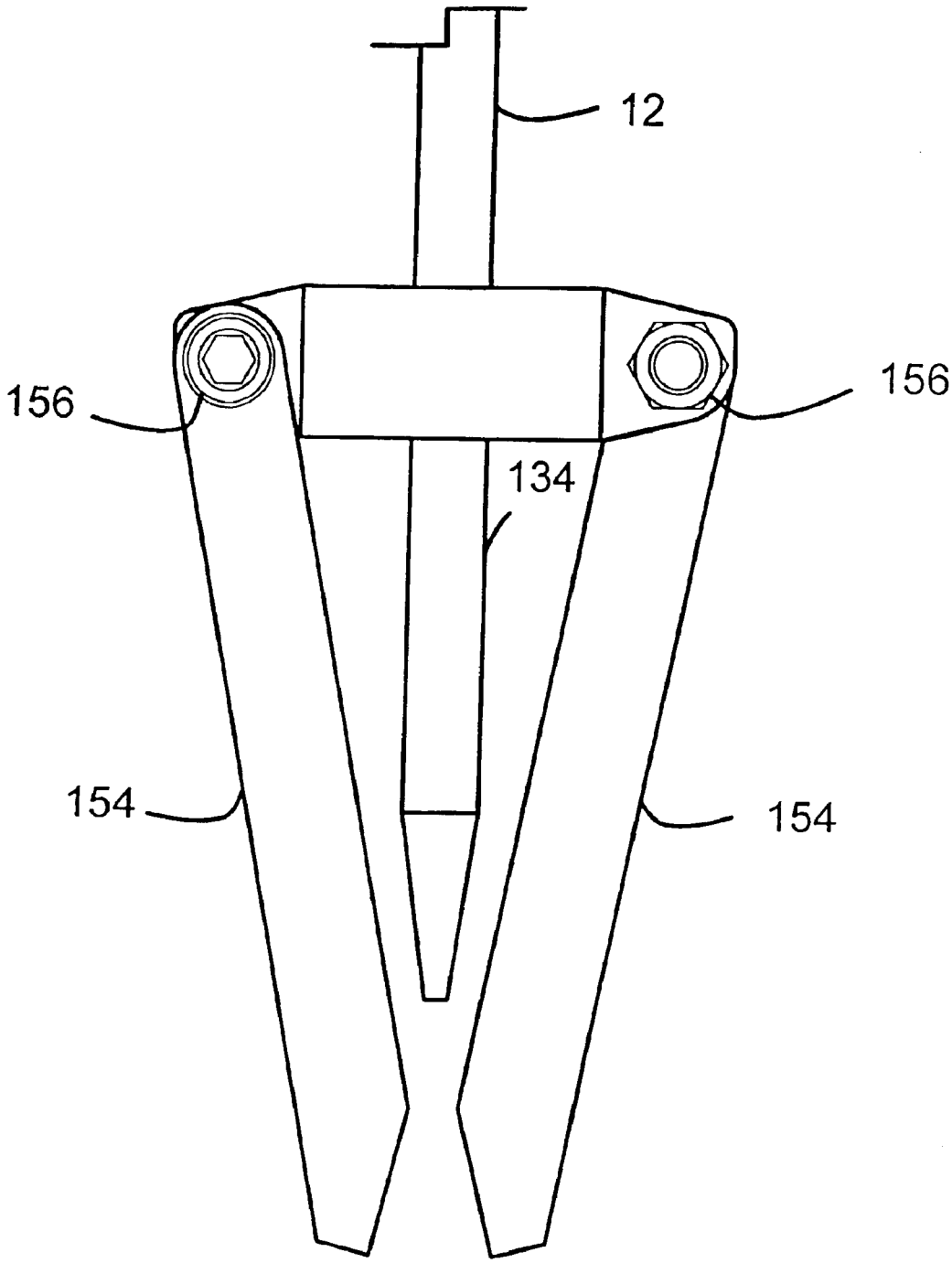
FIG. 15 is an elevational view of a support base having an array of foldable legs, showing the legs in a folded orientation, according to the invention.

FIG. 15 depicts a support base comprising a foldable stand 150 where the foldable legs 154 are moved to a position aligned with the support rod (support rod 12, in this embodiment). Attachment of the foldable stand 150 to the support rod 12 is similar to the attachment of the quadrapod stand 120 to the support rod 12 described above.

Figure 16:
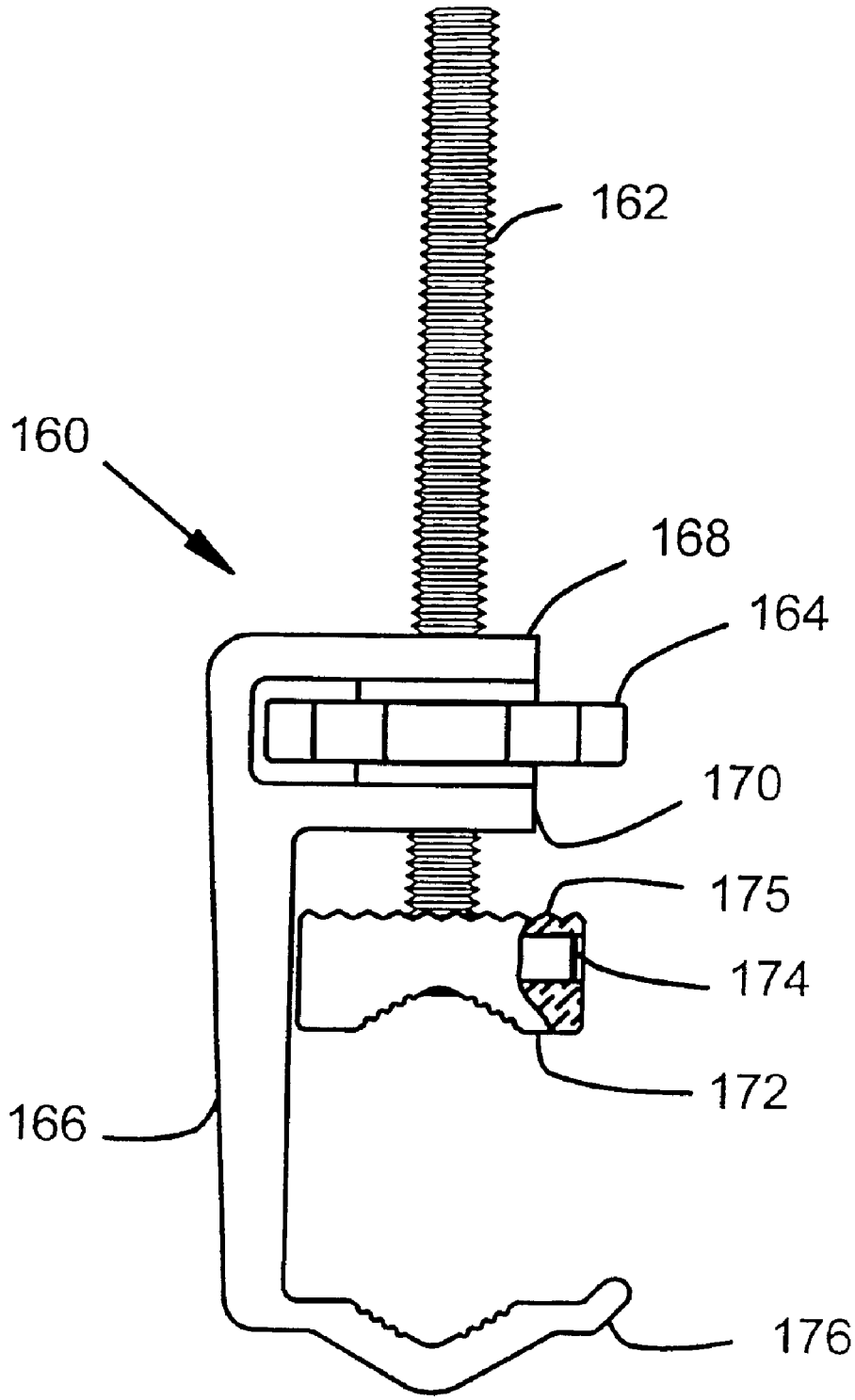
FIG. 16 is an elevational view of a clamp for a gun support according to the invention.

An alternate embodiment the support base comprises a clamp to attach the gun support to a tree limb, tree root, rock, or other similar anchoring object. FIG. 16 illustrates one embodiment of such a clamp, depicting clamp device 160. Clamp device 160 incorporates a clamp fastener 162, depicted herein as a threaded portion that, for example, may be screwed into mating threads inside the distal end 16 of the support rod 12 depicted in FIG. 1. Thus it is seen that in some embodiments the clamp device 160 and the lance 134 may be provided as interchangeable accessories. The clamp device 160 may also be used instead of quadrapod stand 120 or foldable stand 150.

The clamp device 160 of the FIG. 16 embodiment further comprises a clamp body 166, an upper clamp flange 168, a lower clamp flange 170, and a lower clamp jaw 176. A clamp tightening knob 164 is set between the upper clamp flange 168 and the lower clamp flange 170. The clamp fastener 162 passes loosely through the upper clamp flange 168, is threaded through the clamp tightening knob 164, passes loosely through the lower clamp flange 170, and finally is threaded into the upper clamp jaw 172. A set screw 174, shown in a partial cut-away, secures the upper clamp jaw 172 to the clamp fastener 162. As the clamp tightening knob 164 is rotated in one direction or the other, the upper clamp jaw 172 moves toward and away from the lower clamp jaw 176. This action can be used to attach or remove the clamp device 160 to or from an anchoring object. In an alternate embodiment, the upper clamp jaw 172 may be removed from the clamp fastener 162 and rotated so that surface 175 faces the lower jaw 176 for use of the clamp device 160 on a substantially planar surface.

Other alternate embodiments incorporate replaceable attachments that can be substituted for the cradle. For example, in some embodiments the support rod 12 can be configured to accommodate removal of the cradle and temporarily affixing a small hand saw to the support rod 12. A hand saw is of considerable utility to hunters who may want to trim branches from trees in order to maintain an unobstructed view of the field. In another alternate embodiment, the support rod 12 can be configured to accommodate removal of the cradle and temporarily affixing a camera to the support rod 12. This facilitates taking pictures in the field. When a camera is attached to the support rod 12, it is preferred that ball joint swivel 90 described above also be used.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A gun support for hunters, comprising:

a support rod having a proximal end and a distal end;

a cradle removably attached to the proximal end of the support rod;

the cradle comprising, a base, a first fork pending from a first side of the base, a second fork pending from a second side of the base, and a retaining device disposed on the first and second fork; and an elastic biasing strap having a substantially oblong opening between opposite sides thereof and opposite ends thereof removably attached to the retaining device on at least one of the first fork and second fork, wherein the biasing strap is configured for retaining a gun barrel between the strap and the base of the cradle.

2. The gun support of claim 1, wherein the biasing strap comprises an elongate strap having a substantially oblong opening between opposite sides thereof and opposite ends thereof.

3. The gun support of claim 2, wherein the retaining device comprises a pawl disposed on each of the first and second forks.

4. The gun support of claim 2, wherein the retaining device comprises a pawl disposed on the second fork and an opening disposed on the first fork.

5. The gun support of claim 4, wherein the opposite ends of the biasing strap comprises a first end and a second end, wherein the first end contains a compressible barb for insertion in the opening disposed on the second fork.

6. The gun support of claim 5, wherein the biasing strap further comprises a tab attached to the second end of the strap for stretching the strap over the first and second forks to retain the gun barrel between the strap and the base of the cradle.

7. The gun support of claim 1, wherein the support rod comprises a telescoping support rod.

8. The gun support of claim 1, wherein the cradle comprises a shock-absorbing cradle.

9. The gun support of claim 1, wherein the support rod comprises a camouflage pattern on exposed surfaces thereof.

10. The gun support of claim 1, wherein the cradle comprises a camouflage pattern on exposed surfaces thereof.

11. The gun support of claim 1, further comprising a support base removably attached to the distal end of the support rod.

12. The gun support of claim 11, wherein the support base comprises a quadrapod stand composed of two elongate members rotatably joined to a shaft in a center of each of the members.

13. The gun support of claim 11, wherein the support base comprises a clamp for clamping engagement with an anchoring object.

14. The gun support of claim 11, wherein the support base comprises a lance removably attached to the distal end of the support rod for insertion in an object.

15. The gun support of claim 1, wherein the support rod comprises a telescoping support rod having a length adjustable from about nine inches to about six feet.

16. A gun rest for hunters, comprising:

a support rod having a proximal end and a distal end;

a cradle removably attached to the proximal end of the support rod;

the cradle comprising a base and a first fork pending from a first side of the base and a second fork pending from a second side of the base, where the base is attached to the proximal end of the support rod and the first fork and the second fork form a generally urceolate profile; and a removable elastic biasing strap having a substantially oblong opening between opposite sides thereof and opposite ends thereof which attaches to the first fork and the second fork of the cradle at a narrow point in the urceolate profile.

17. The gun rest of claim 16 further comprising a swivel assembly disposed between the cradle and the proximal end of the support rod for connecting the cradle to the support rod.

* * * * *